United States Patent [19]

Bell et al.

[11] 4,332,371

[45] Jun. 1, 1982

[54] CARPET REMOVING APPARATUS AND METHOD

[76] Inventors: Dwain C. Bell, 1400 Marshall St., NE., Minneapolis, Minn. 55413; Lloyd E. Anderson, 6408 - 74th Ave. North, Minneapolis, Minn. 55428

[21] Appl. No.: 194,597

[22] Filed: Oct. 6, 1980

[51] Int. Cl.[3] ..... B66D 1/00

[52] U.S. Cl. ..... 254/203; 156/344; 254/334

[58] Field of Search ..... 29/426.5; 156/344, 584, 156/247; 254/202, 203, 211, 212, 334, 213

[56] References Cited

U.S. PATENT DOCUMENTS

| | | | |
|---|---|---|---|
| 416,725 | 12/1899 | Foster et al. | 254/208 |
| 593,328 | 5/1895 | Anthony | 254/213 |
| 1,459,693 | 6/1923 | Rand et al. | 156/344 |
| 2,853,273 | 9/1958 | Berge | 254/334 |
| 3,929,555 | 12/1975 | Sanders | 156/184 |

*Primary Examiner*—Billy S. Taylor
*Attorney, Agent, or Firm*—Orrin M. Haugen; Thomas J. Nikolai

[57] ABSTRACT

An apparatus and method for removing worn carpeting which may have been adhesively bonded to the floor of a building. The method involves the steps of affixing a power winch mechanism to the floor of the building proximate one side edge of the carpet to be removed and affixing pulleys, in pairs, on opposite side edges of the room. A rope from the winch is routed through said pulleys and the free end thereof is connected to an elongated clamp mechanism secured to one edge of the carpet to be removed. By energizing the power winch, the old carpeting is peeled back to the middle of the room, at which time, the rope is routed through a different pulley to a further carpet clamp whereby the pulling force acts in an opposite direction to complete the peeling of the remaining half of the carpeting to the middle of the room.

2 Claims, 3 Drawing Figures

CARPET REMOVING APPARATUS AND METHOD

BACKGROUND OF THE INVENTION

I. Field of the Invention

This invention relates generally to a technique for facilitating the removal of carpeting from the floor of a room when that carpeting had been installed using an adhesive bonding technique, and more specifically to a method employing a winch and pulley apparatus whereby the labor involved is considerably reduced.

II. Discussion of the Prior Art

When installing carpeting in industrial and commercial facilities it has been the practice to adhesively bond large carpet sections to the floor of the building to prevent slippage, bubbling, and premature wear. While the adhesive bonding technique affords these advantages, it creates a problem at the time that such carpeting is to be removed and replaced. This is true whether the carpeting employed is of the jute-backed or the rubber-backed variety. Stripping machines have been developed wherein a power driven scraper head is inserted between the carpeting and the floor and is used to free the carpeting from the floor, generally in narrow strips, typically six to ten inches in width. When it is considered that in many instances carpeting wears only in high traffic areas, the use of the power driven scraper-type stripper ruins those portions of the carpeting which would otherwise be still usable.

In addition, the power driven stripper of the type described above is relatively slow in its operation and wasteful of labor.

SUMMARY OF THE INVENTION

In accordance with the teachings of the present invention, the difficulties inherent in the removal of adhesively bonded carpeting are obviated. Through the use of the method and apparatus of the present invention, full widths of adhesively bonded carpeting may be removed from a floor in a minimum of time and with a minimum of manual effort.

In carrying out the method, a portable winch mechanism is anchored to the floor in one corner of the room whose carpeting is to be removed. One or more pairs of pulleys are also secured to the floor along opposite edges of the carpeting to be removed and a rope is routed through a first pulley on the same side of the room as the winch mechanism and from there through a second pulley on the opposite side of the room back to the edge of the carpeting on the first side of the room where it is secured to that edge by way of an elongated clamping bar mechanism. Thus, when power is applied to the winch and the rope is wound up on it, a pulling force is applied to the edge of the carpeting and the carpet is peeled back until a point approximate the middle of the room is reached. At this point, the clamping bar is coupled to the other edge of the carpet and, again, the winch mechanism is energized to peel the remaining portion of the carpeting to the center of the room. This process is repeated for subsequent carpet widths until the entire room has been cleared. In that the carpeting is removed in continuous widths, those portions which were not subject to undue wear may be reused.

OBJECTS

It is accordingly the principal object of the present invention to provide a new method for removing carpeting from a room where that carpeting had previously been adhesively bonded to the floor.

Another object of the invention is to provide an apparatus for carrying out the foregoing method.

These and other objects and advantages of the invention will become apparent to those skilled in the art from the following detailed description of a preferred embodiment when considered in conjunction with the accompanying drawings in which like numerals in the several views refer to corresponding parts.

DESCRIPTION OF THE PREFERRED EMBODIMENT

Figure 1:
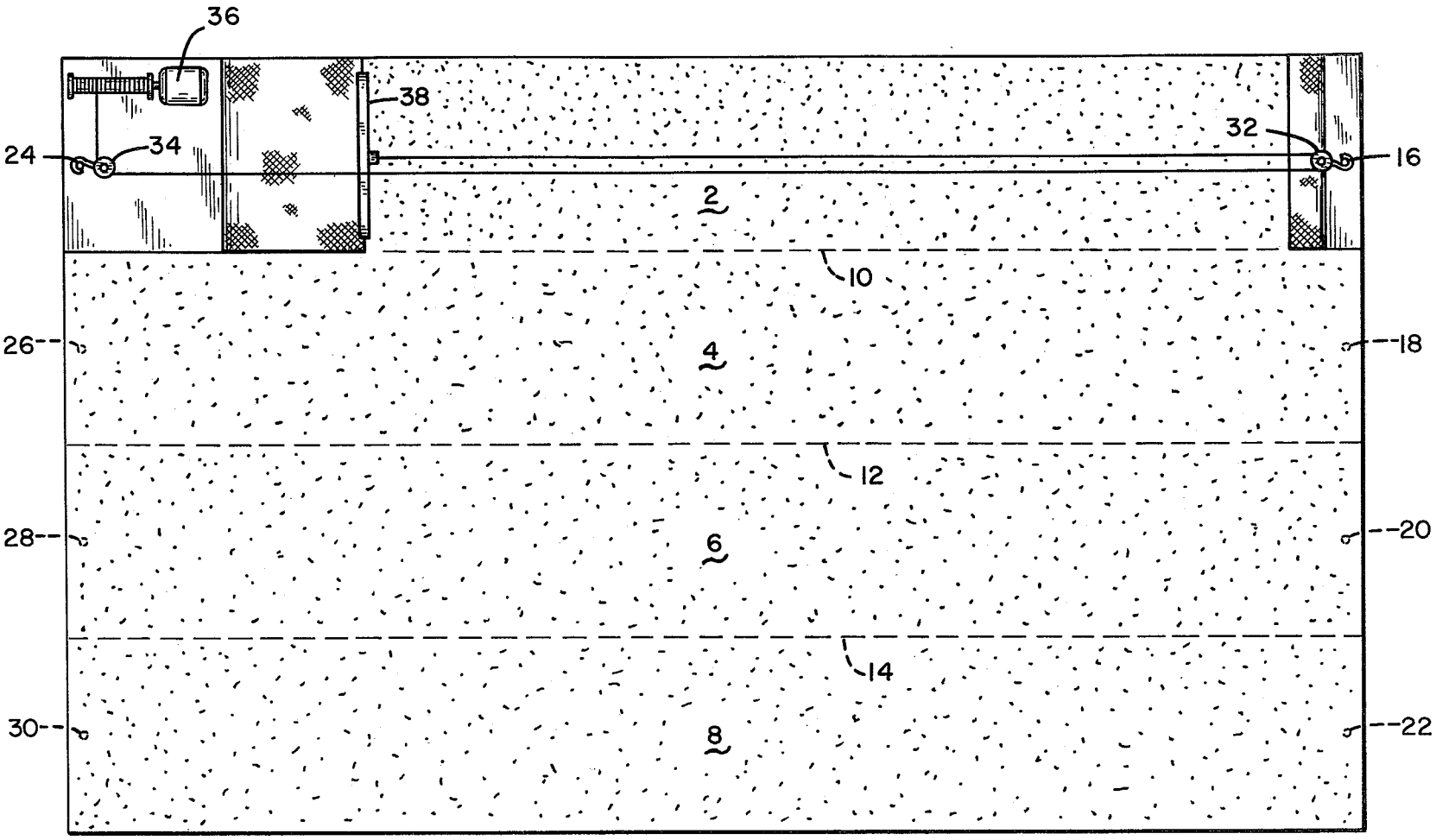
FIG. 1 illustrates the setup of the apparatus for carrying out the method of carpet removal in accordance with the present invention.
Figure 2:
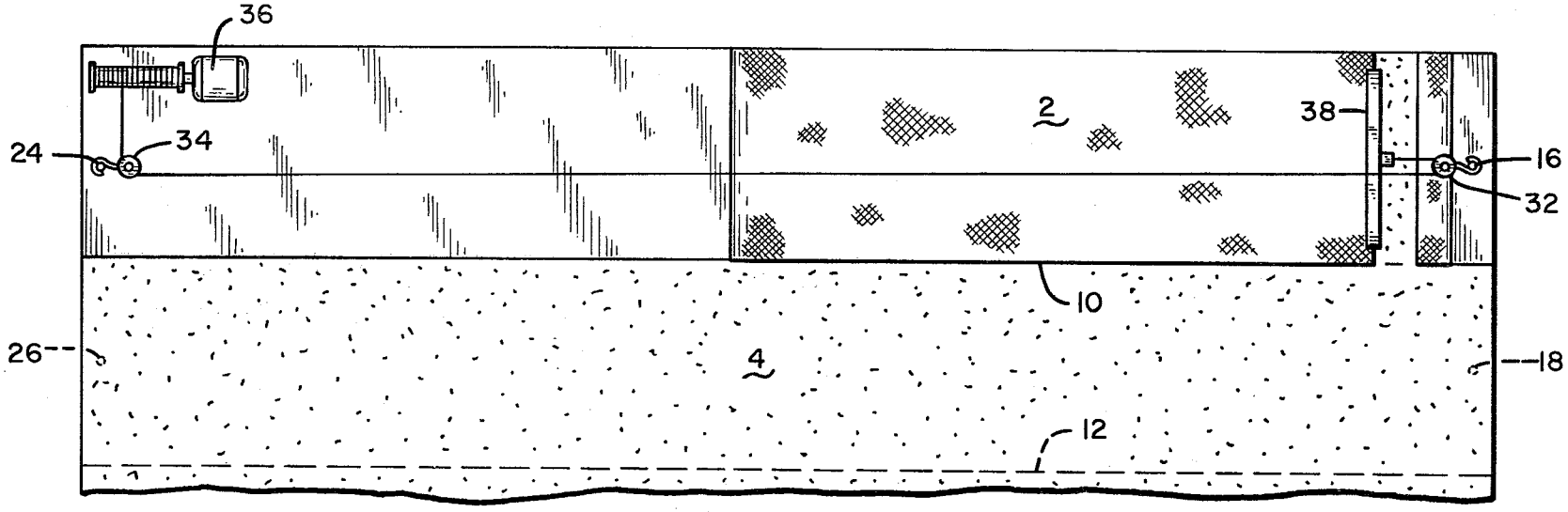
FIG. 2 illustrates the arrangement of the apparatus at a later stage in the carpeting removal process.
Figure 3:
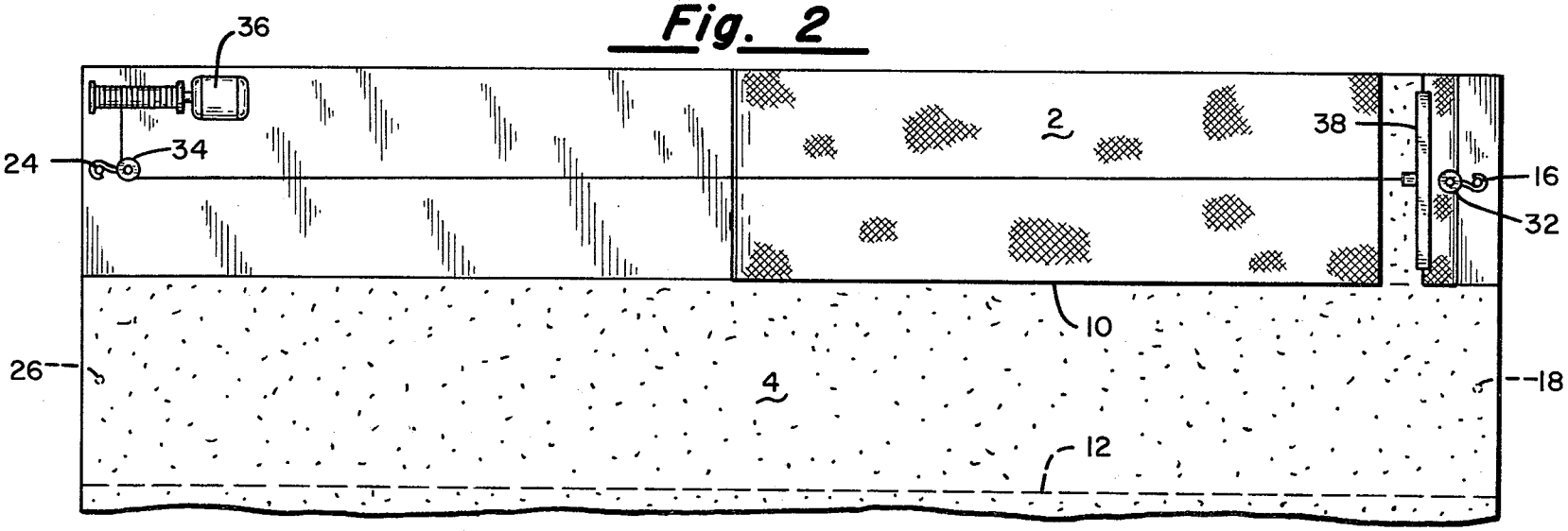
FIG. 3 illustrates a still further arrangement for effecting a third step in the process.

FIGS. 1 through 3 illustrate plan views of a carpeted floor during successive stages of the carpet removal process in accordance with the teachings of the present invention. It is assumed that the carpeting had originally installed by laying a plurality of courses, each of a predetermined width, side-by-side. In the drawings, the courses are identified by numerals 2, 4, 6 and 8, the hidden seams between each course being represented by the broken lines 10, 12 and 14. Typically, the carpeting may be of the rubber-backed variety or, alternatively, may be jute-backed, it being understood that during installation, the several course of carpeting were adhesively bonded to the floor of the room. Typically, each course may be between twelve and fifteen feet in width and is of a continuous length.

Now, with reference to FIG. 1, in carrying out the first step of the method, each carpeting course is peeled away at both ends from the floor, by hand, for a short distance, typically one foot, and a hole of a predetermined diameter is drilled into the floor near the wall to provide an anchoring point for a pulley as will be further described. The holes in the floor are identified in FIG. 1 by numerals 16, 18, 20 and 22 at the rightmost end of the room and by numerals 24, 26, 28 and 30 at the leftmost end of the room. A steel pin or rod is next inserted to a predetermined depth into the holes 16 and 24 associated with the topmost course of carpeting 2 and a pair of pulleys 32 and 34 are coupled to the pins so as to be firmly anchored in place centrally at opposed end edges of the carpeting course to be removed.

An electric motor driven winch is provided as at 36 and a rope from the winch is first routed through the pulley 24 and thence through the pulley 16 and the free end thereof is tied or otherwise joined to an elongated clamping bar 38 which is joined to a free end edge of the carpeting to be removed.

Now, when power is applied to the motor driving the winch, the rope begins to wind up on the winch and, in doing so, a substantial force is applied to the clamping bar 38 tending to peel back the left end of the upper carpeting strip. The view of FIG. 2 illustrates the arrangement of the apparatus at the stage in the process where approximately half of the overall length of the upper strip of carpeting 2 has been peeled back so that it now overlays the righthand half of this course which still remains adhesively bonded to the floor. At this point, the elongated carpet clamping bar 38 has been pulled to a location proximate the pulley 32.

Next, and as indicated in FIG. 3, the end of the rope which had been secured to the clamping bar 38 is temporarily unfastened and allowed to be pulled free from the pulley 32. That free end of the rope is again fastened to the clamping bar 38 and the clamping bar is removed from the lefthand edge of the carpeting strip 2 and is secured to the rightmost edge thereof. Now, as the rope is continued to be wound upon the winch, the rightmost edge of the carpeting will be peeled back and pulled toward the center of the room. As the clamping bar 38 is dragged closer and closer to the leftmost pulley 34, a point will be reached where the carpeting has been peeled totally free from the underlying floor surface.

At this point, the pulleys 32 and 34 are moved to the adjacent course of carpeting 4 to be removed and are anchored by steel pins in the previously drilled holes 18 and 26. The sequence previously described is repeated until all of the carpeting courses have effectively been loosened from the floor.

In practicing the invention, it has been found expedient to utilize a $\frac{3}{4}$ horsepower alternating current motor which is coupled to the winch by way of a gear reduction box having a gear ratio of, typically, 60:1. With this arrangement, pulling forces in the range of from 2,000 to 3,000 pounds may be applied to a carpeting course tending to free it from the floor. By using elongated clamping bars such as the clamping bar 38, this force is more uniformly applied along the carpet's edge and little or no tearing or destruction of the carpeting occurs. As such, those portions of a carpet which had previously resided in low traffic areas may be salvaged and re-used.

In two identical carpet removal jobs involving approximately 2,000 square yards, one using the method of this invention and the other using a conventional, prior art stripping machine, a saving of 66 man-hours was realized using the present invention. Then too, the use of the stripping machine required that the carpeting be removed in nine inch wide strips which, of course, totally destroyed the carpeting, precluding any subsequent use. The carpet removal method of the present invention, however, permitted reuse of 90% of the removed carpeting.

Thus it can be seen that there is provided by the present invention a novel method for removing carpeting that had previously been adhesively bonded in place. The invention has been described herein in considerable detail, in order to comply with the Patent Statutes and to provide those skilled in the art with information needed to apply the novel principles and to construct and use such specialized equipment as are required in practicing the method. However, it is to be understood that the invention can be carried out by specifically different equipment and devices, and that various modifications, both as to equipment details and to the operating procedures for practicing the method can be effected without departing from the scope of the invention itself.

What is claimed is:

1. A method of stripping a floor covering from a floor surface to which said floor covering had been adhesively bonded, comprising the steps of:

(a) loosening opposing first and second edges of said floor covering from the floor surface inwardly for a relatively short predetermined distance from each end thereof to expose the underlying floor surface;

(b) anchoring first and second pulleys to the floor surfaces so exposed;

(c) routing a rope or cable from a power winch through said first pulley, across the floor covering to be removed, through said second pulley and back to said first edge of said floor covering proximate said first pulley;

(d) clamping said first edge of said floor covering proximate said first pulley along a predetermined width thereof in an elongated clamping means;

(e) fastening said cable or rope to said clamping means; and (f) energizing said power driven winch to apply a pulling force to said first edge of said floor covering to thereby peel the floor covering from said floor surface in a direction away from said first pulley until said clamping means is proximte said second pulley.

2. A method of stripping a floor covering from a floor surface to which said floor covering had been adhesively bonded, comprising the steps of:

(a) loosening opposing first and second edges of said floor covering from the floor surface inwardly for a relatively short predetermined distance from each end thereof to expose the underlying floor surface;

(b) anchoring first and second pulleys to the floor surfaces so exposed;

(c) routing a rope or cable from a power winch through said first pulley, across the floor covering to be removed, through said second pulley and back to said first edge of said floor covering proximate said first pulley;

(d) clamping said first edge of said floor covering proximate said first pulley along a predetermined width thereof in an elongated clamping means;

(e) fastening said cable or rope to said clamping means;

(f) energizing said power driven winch to apply a pulling force to said first edge of said floor covering to thereby peel the floor covering from said floor surface in a direction away from said first pulley until said clamping means is proximate said second pulley; and (g) uncoupling said rope from said second pulley;

(h) clamping the second edge of said floor covering proximate said anchoring point of said second pulley in said elongated clamping means; and (i) again energizing said power driven winch to apply a pulling force to said second edge of said floor covering to thereby peel the floor covering from said floor surface in a direction toward said first pulley until said clamping means is drawn to a location proximate said first pulley.

* * * * *